US007455592B2

(12) United States Patent
Kroon

(10) Patent No.: US 7,455,592 B2
(45) Date of Patent: Nov. 25, 2008

(54) SUPPORT INSTALLATION FOR A FAIRGROUND ATTRACTION

(75) Inventor: Albert Louisito Phillipus Kroon, Neede (NL)

(73) Assignee: Cobra Beheer B.V., Ae Neede (NL)

( * ) Notice: Subject to any disclaimer, the term of this patent is extended or adjusted under 35 U.S.C. 154(b) by 286 days.

(21) Appl. No.: 11/239,919

(22) Filed: Sep. 30, 2005

(65) Prior Publication Data

US 2006/0079338 A1 Apr. 13, 2006

(30) Foreign Application Priority Data

Oct. 1, 2004 (NL) ..... 1027163

(51) Int. Cl.
*A63G 1/28* (2006.01)

(52) U.S. Cl. ..... 472/3; 472/30; 472/38

(58) Field of Classification Search ..... 472/3, 472/44, 45, 29, 30, 38; 280/143
See application file for complete search history.

(56) References Cited

U.S. PATENT DOCUMENTS 2,847,216 A 8/1958 Courtney
3,456,943 A 7/1969 Brown
3,612,517 A * 10/1971 Schwarzkopf ..... 472/3
4,988,089 A * 1/1991 Knijpstra ..... 472/3
6,634,952 B2 * 10/2003 Kroon et al. ..... 472/3
2003/0162596 A1 8/2003 Kroon et al.

FOREIGN PATENT DOCUMENTS

DE 21 34 415 A1 1/1973
DE 29 37 703 A1 4/1981

* cited by examiner

*Primary Examiner*—Kien Nguyen
(74) *Attorney, Agent, or Firm*—The Webb Law Firm

(57) ABSTRACT

A support installation for a fairground attraction, comprises a base, two pairs of masts which can be moved between a collapsed and an erected position, as well as a head that in the erected position is at the top of the masts, on which head a Ferris wheel or a swing or the like can be mounted, wherein the masts each comprise several segments that are joined to one another such that they can pivot. Each mast has a base segment that is joined to the base such that it can pivot, as well as a top segment that is joined to the head, at least in the erected position. Relatively high masts can be obtained with this construction.

14 Claims, 6 Drawing Sheets

SUPPORT INSTALLATION FOR A FAIRGROUND ATTRACTION

BACKGROUND OF THE INVENTION

1. Field of the Invention

The invention relates to a support installation for a fairground attraction, comprising a base, two pairs of masts which can be moved between a collapsed and an erected position, as well as a head, which is at the top of the masts when the masts are in the erected position, for fixing a Ferris wheel or a swing or the like thereto, wherein the masts each comprise several segments that are joined to one another such that they can pivot.

2. Description of the Related Art

A support installation of this type is disclosed in U.S. Pat. No. 6,634,952 B2. With this installation the masts of each pair in the erected position form two sides of a triangle and the base forms the third side of said triangle. The base segment of one of the masts of each pair is fixed with respect to the base, whilst the base segment of the other mast is joined to the base such that it can pivot. Said fixed base segment is relatively short, so that the associated top segment can be relatively long. However, the length of the top segment must be less than the length of the base, because otherwise this top segment would protrude with respect to the base in the collapsed position. This is highly undesirable, especially also because of the fact that the base is usually constructed as a trailer for transport by road. The length of the segments of the other mast of each pair is approximately half the length of the base. One disadvantage of this support installation is, therefore, that the height thereof is restricted in the erected position.

SUMMARY OF THE INVENTION

The aim of the present invention is to provide a support installation for a fairground attraction that can be collapsed and does not have this disadvantage, so that higher attractions are possible. Said aim is achieved in that each mast has a base segment that is joined to the base such that it can pivot, as well as a top segment that is joined to the head, at least in the erected position. Because both base segments are joined to the base such that they can pivot, the height of the support installation can be appreciably increased. For example, both the base segment and the top segment can be approximately the same length as the base, without protruding with respect to said base in the collapsed position. By this means the height of the support installation can therefore be approximately twice that of the known support installation.

An embodiment where each mast has two and only two segments which, in the collapsed position, are essentially alongside or on top of one another and along or on top of the base is preferred.

According to a first variant each base segment and each top segment is essentially the same length as the base and the top segments of both masts of each pair are joined to one another by means of a detachable coupling. In this case the height of the erected support installation is approximately twice the length of the base. The support installation can be erected while the head remains joined to the top segments of a respective pair of masts.

In a second variant each mast has a base segment that is essentially the same length as the base, as well as a top segment that has a length that is approximately equal to half the length of a base segment. In this case the top segments can be joined to one another by a permanent pivot coupling.

In the case where each mast has only two segments it suffices for stabilization of the erected support installation to fix only the base segments with respect to the base. In an advantageous embodiment fixing takes place by means of actuators which also provide for erection of the support installation. These actuators can, for example, be constructed as hydraulic piston/cylinder devices that at one end are joined to the base and at the other end are joined to a base segment; stabilisation of the support installation can then be effected by fixing the length of said hydraulic piston/cylinder devices.

It is not necessary to use hydraulic piston/cylinder devices for stabilisation of the masts. Instead of this, stabilisation can also be obtained by means of mechanical locking means, such as between the base segments and the base.

With the support installation according to the invention the segments of each mast, in the collapsed position, can be essentially alongside or on top of one another and along or on top of the base. This is made possible in that the pivot joints between the masts and the base are oriented transversely to the longitudinal direction of the base, such as a trailer and the like. Furthermore, the pivot joints between the segments are also essentially oriented transversely to said longitudinal direction.

Reference is made to the support installation as disclosed in DE-A 21 34 415. Masts that consist of two segments are used in this known support installation. These segments are joined to one another such that they can pivot. Furthermore, the masts are joined to the base such that they can pivot, and specifically in accordance with pivot links, the axis of which is oriented in the longitudinal direction of said base. With this known support installation the masts can therefore not be alongside or on top of one another and along or on top of the base in the collapsed position. The segments can be accommodated in this position on the base only if the pivot joints were first to be dismantled for this purpose. However, such a procedure is highly laborious and in any event renders efficient and rapid construction of the support installation according to the invention impossible.

BRIEF DESCRIPTION OF THE DRAWINGS

The invention will now be explained in more detail with reference to the following figures.

DESCRIPTION OF THE PREFERRED EMBODIMENTS

Figure 1:
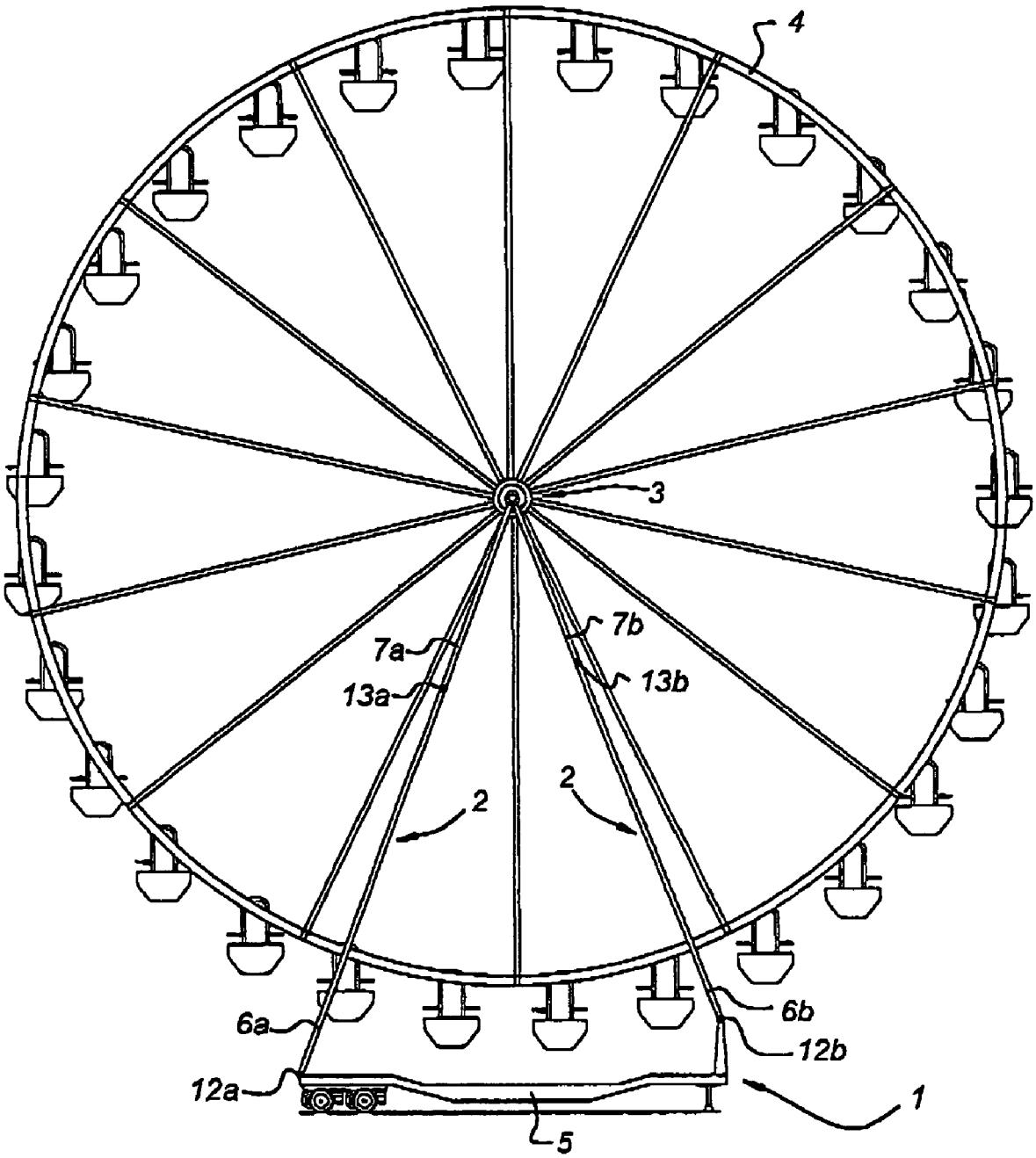
FIG. 1 shows a side view of one embodiment of the invention, where the support installation supports a Ferris wheel.
Figure 2:
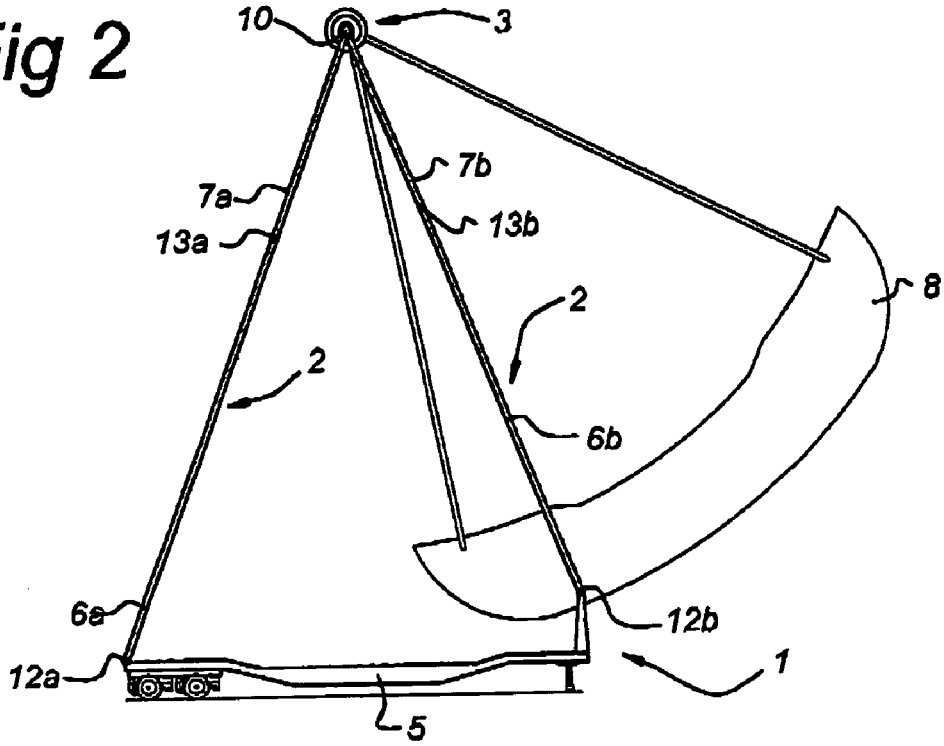
FIG. 2 shows a side view of an embodiment of the invention where the support installation supports a swing.
Figure 3A:
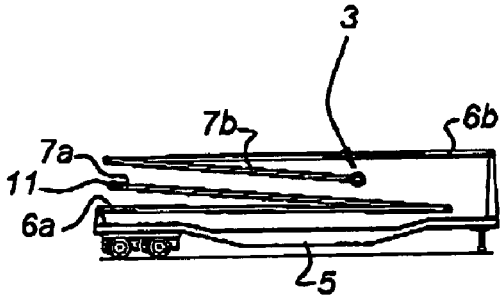
FIG. 3 shows, in side view, the various stages of erection of a first embodiment of the invention.
Figure 3B:
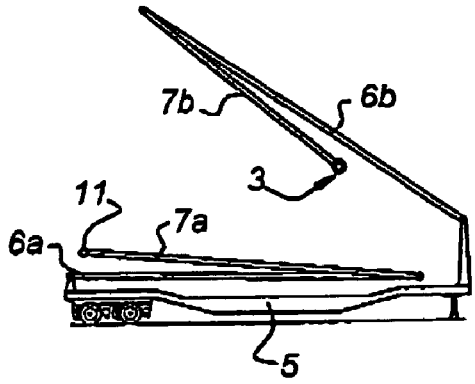
Figure 3C:
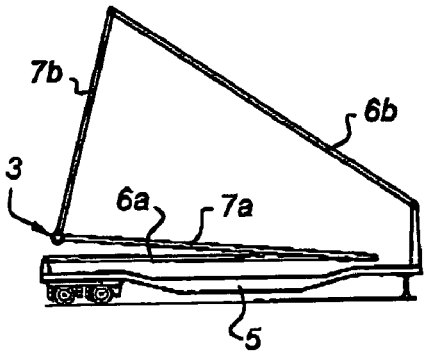
Figure 3D:
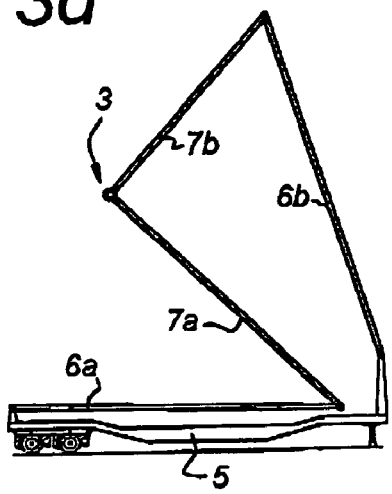
Figure 3E:
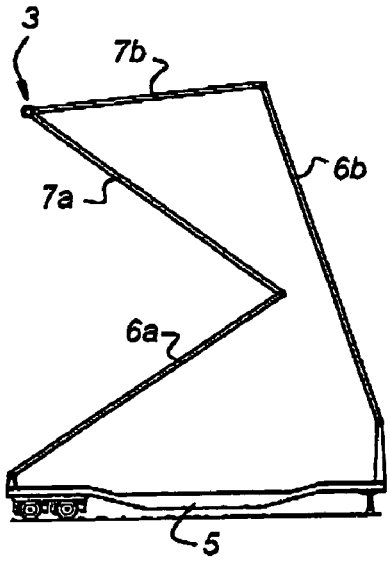
Figure 3F:
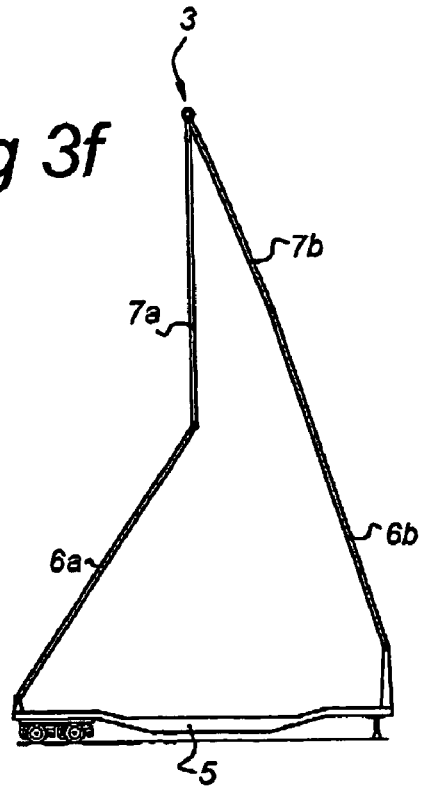
Figure 3G:
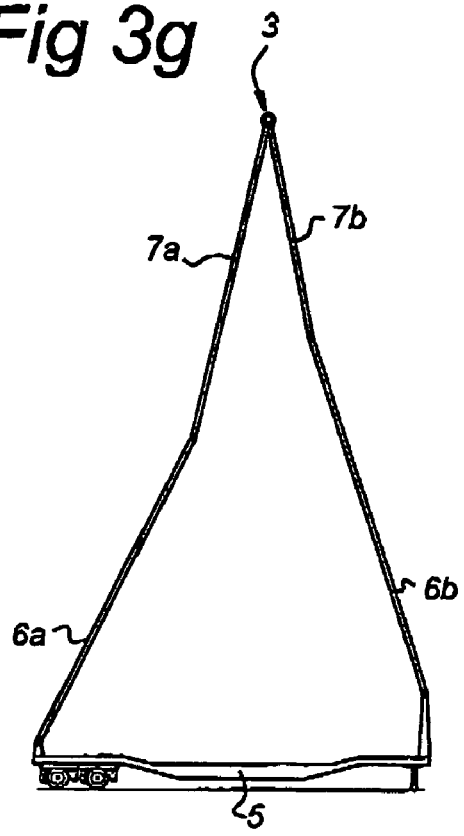
Figure 3H:
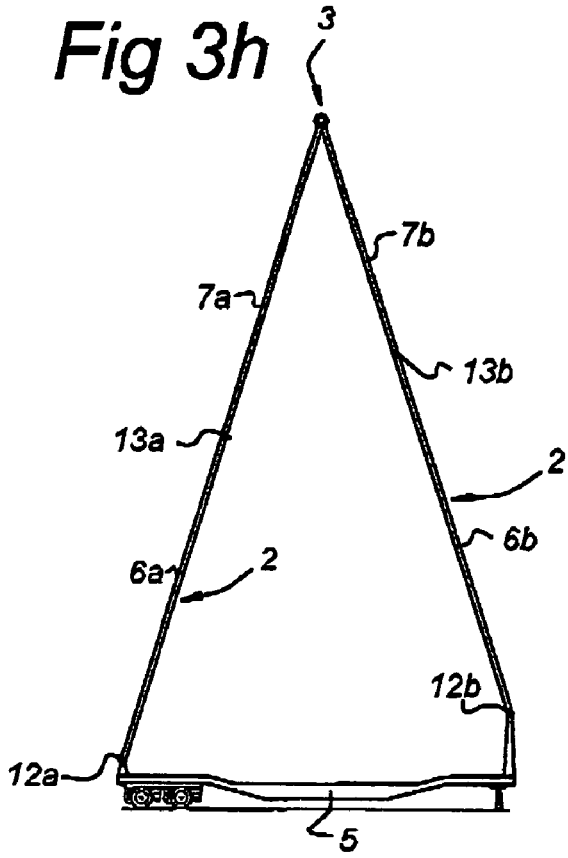
Figure 4A:
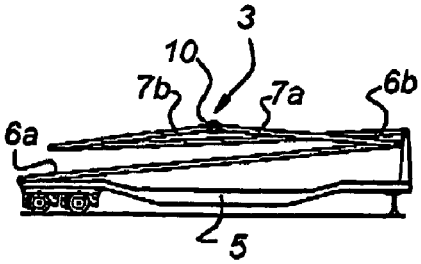
FIG. 4 shows, in side view, the various stages of erection of a second embodiment of the invention.
Figure 4B:
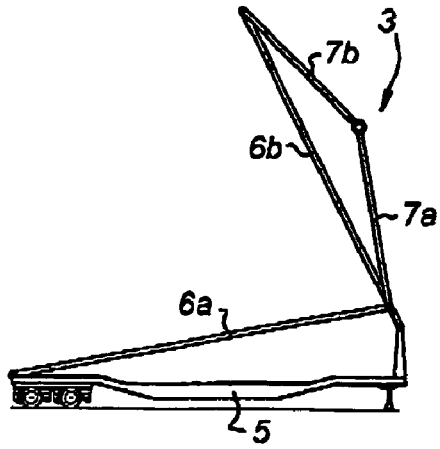
Figure 4C:
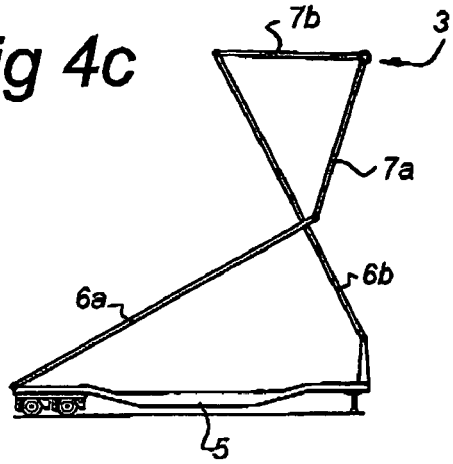
Figure 4D:
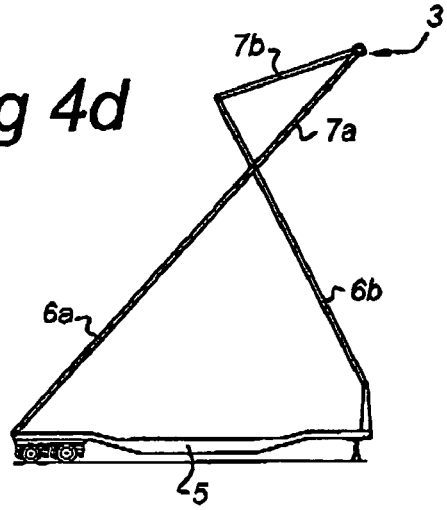
Figure 4E:
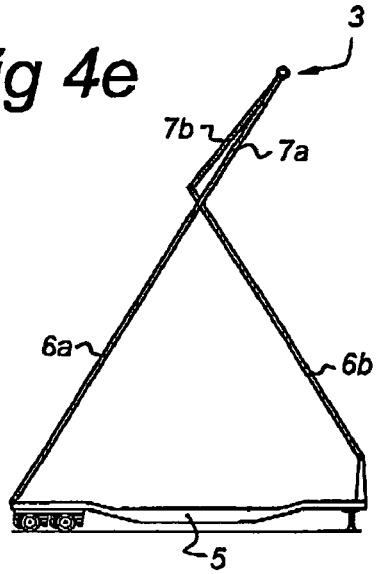
Figure 4F:
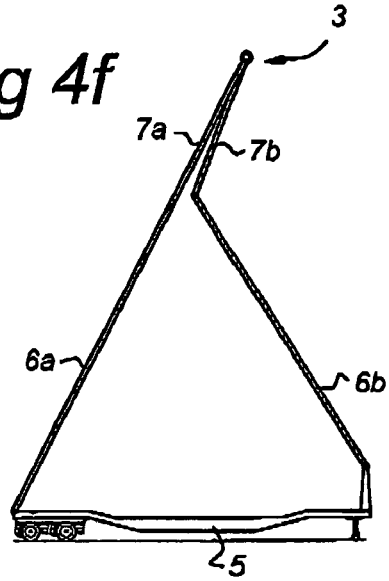
Figure 4G:
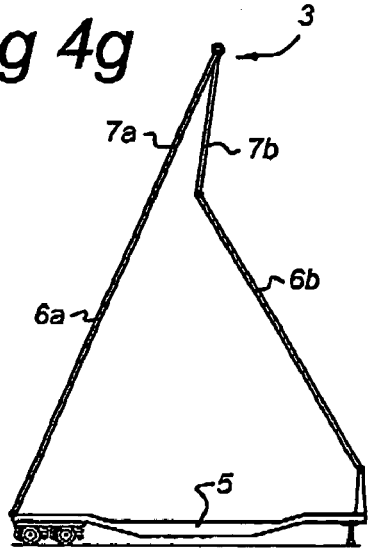
Figure 4H:
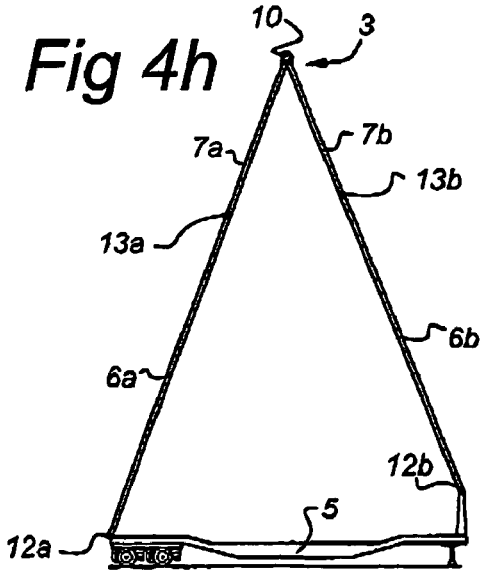

A support installation 1 according to the invention can be seen in FIG. 1. At the top of a pair of masts 2 of the support installation there is a head 3 on which a Ferris wheel 4 has been mounted such that it can rotate. The masts have a base segment 6*a*, 6*b* that is joined by means of pivot links 12*a*, 12*b* to base 5 such that it can pivot, and a top segment 7*a*, 7*b* that is joined to the head. Pivot links 13*a*, 13*b* form the link between the base segments and the top segments. It can be seen that the support installation is appreciably higher than the length of the base; as a result it is possible to construct the Ferris wheel with a diameter of almost twice the height of the support installation. The support installation can, for example, also support a swing 8, as can be seen in FIG. 2.

FIG. 3 shows the erection of a pair of masts according to a first embodiment of the invention. Each mast has a base segment 6*a*, 6*b* and a top segment 7*a*, 7*b*, which are essentially the same length as the base. In the collapsed position these segments are alongside one another and along the base, as shown in FIG. 3*a*. When erecting the support installation, the base segment 6*b* of one of the pair of masts is first raised, see FIG. 3*b*, until the top segment 7*b* of said mast can be coupled by means of a detachable coupling 11 to the top segment 7*a* of the other mast, see FIG. 3*c*. The support installation can then be fully erected by raising the base segments 6*a*, 6*b*, as can be seen in FIGS. 3*d* to 3*h*, the top segments remaining coupled such that they can pivot.

FIG. 4 shows the erection of a pair of masts according to a second embodiment of the invention. Each mast has a base segment 6*a*, 6*b* that is essentially the same length as the base 5, and a top segment 7*a*, 7*b*, the length of which is approximately equal to half that of the base segment. The top segments are joined to one another by means of a permanent pivot coupling 10. In the collapsed position the segments are alongside one another and along the base, as shown in FIG. 4*a*. The support installation can now be erected by raising the base segments, as shown in FIGS. 4*b* to 4*h*.

Figure 5:
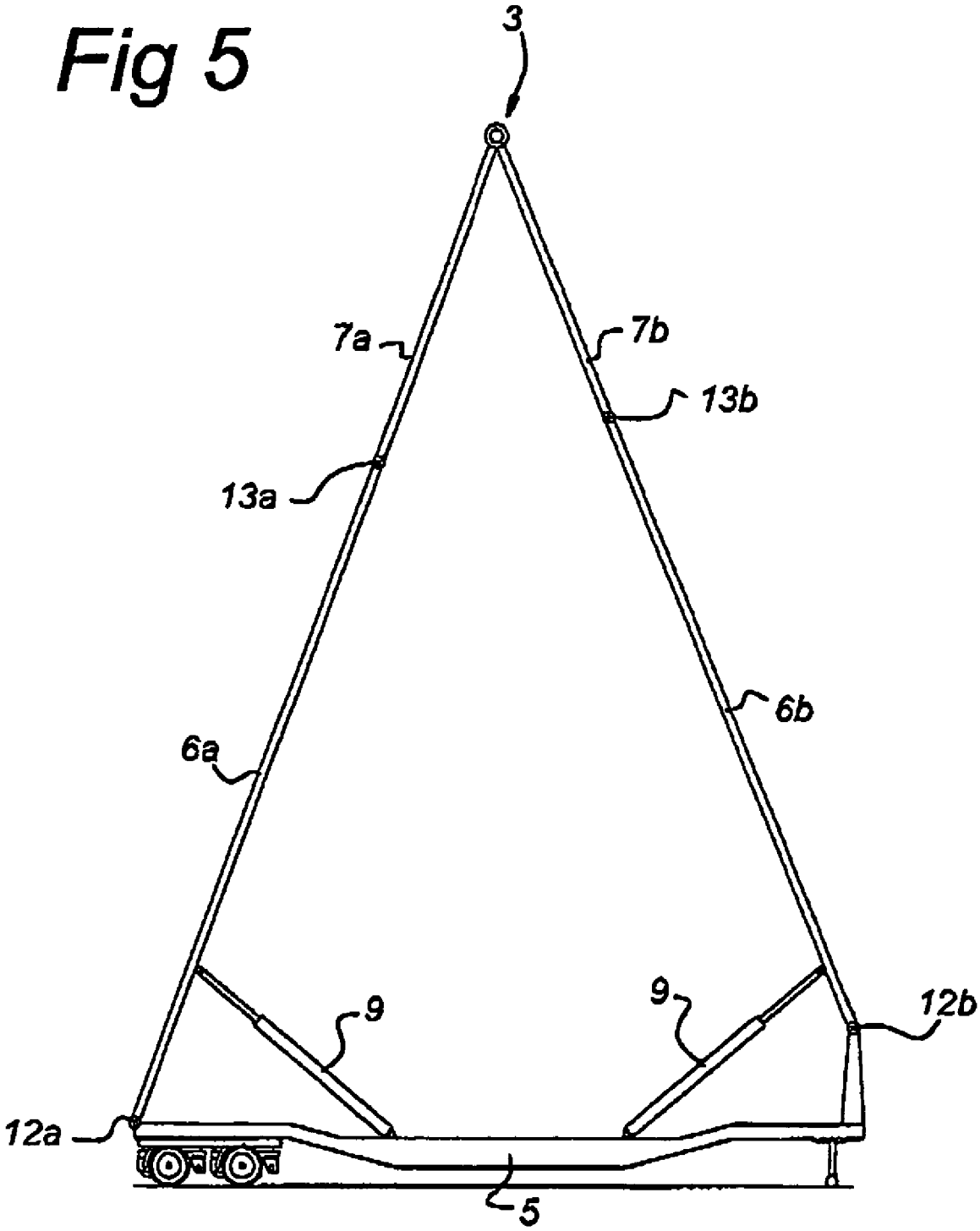
FIG. 5 shows a side view of an embodiment of the invention where the support installation is stabilised by hydraulic piston/cylinder devices.

The support installations in FIG. 4 and FIG. 3 can be stabilised by fixing the base segments with respect to the base; the top segments then have no further freedom of movement. FIG. 5 shows one possible embodiment of such stabilisation, where fixing is effected by means of actuators 9 which also provide for erection of the support installation. These actuators can, for example, be constructed as hydraulic piston/cylinder devices which at one end are joined to the base and at the other end are joined to a base segment. Stabilisation of the support installation is then effected by fixing the length of said hydraulic piston/cylinder devices, for example by shutting off the oil supply thereto.

The invention claimed is:

1. A support installation for a fairground attraction, comprising:

a base;

two pairs of masts adapted to move between a collapsed and an erected position; and a head that is situated at the top of the masts when the masts are in the erected position, wherein the head is adapted to have mounted thereon one of a Ferris wheel and a swing, wherein the masts each, include a plurality of segments that are joined to one another such that the segments pivot with respect to each other, wherein each mast includes a respective base segment joined to the base such that the base segment pivots with respect to the base and a top segment pivots with respect to the base segment, wherein the top segment is joined to the head, wherein each pair of masts in the erected position forms a first and second side of a triangle and the base forms a third side of said triangle, wherein each mast has only two segments, and wherein the base has a longitudinal direction and pivot joints between the segments are oriented essentially transversely to said longitudinal direction.

2. The support installation according to claim 1, wherein in the collapsed position the plurality of segments of each mast are essentially alongside or on top of one another and along or on top of the base.

3. The support installation according to claim 1, wherein each base segment is essentially the same length as the base.

4. The support installation according to claim 3, wherein each top segment is essentially the same length as the base and the top segments of both masts of each pair are joined to one another by a detachable coupling.

5. The support installation according to claim 3, wherein each top segment has a length that is approximately equal to half the length of a base segment.

6. The support installation according to claim 5, wherein the top segments are joined to one another by a permanent pivot coupling.

7. The support installation according to claim 1, wherein stabilisation of the support installation is effected by fixing the base segments with respect to the base.

8. The support installation according to claim 7, wherein each pair of masts is provided with at least one arrestable linear actuator, wherein one end of the arrestable linear actuator is joined to the base and another end of the arrestable linear actuator is joined to one of the base segments.

9. The support installation according to claim 8, wherein each pair of masts includes two arrestable linear actuators, wherein each arrestable linear actuator is joined to a respective base segment.

10. The support installation according to claim 8, wherein each arrestable linear actuator includes a hydraulic piston/cylinder device.

11. The support installation according to claim 1, wherein the base is a trailer.

12. The support installation according to claim 1, wherein the axes of pivot joints between the segments of each mast are essentially parallel to one another.

13. The support installation according to claim 12, wherein the base is oriented in a longitudinal direction and the pivot joints between the masts and the base are oriented transversely to said longitudinal direction.

14. The support installation according to claim 1, wherein the base is oriented in a longitudinal direction and the pivot joints between the masts and the base are oriented transversely to said longitudinal direction.

* * * * *